US006286603B1

(12) United States Patent
Parent

(10) Patent No.: US 6,286,603 B1
(45) Date of Patent: Sep. 11, 2001

(54) PACKING SYSTEM AND METHOD FOR BOREHOLES

(75) Inventor: John Howard Parent, Brampton (CA)

(73) Assignee: Solinst Canada Limited, Georgetown (CA)

( * ) Notice: Subject to any disclaimer, the term of this patent is extended or adjusted under 35 U.S.C. 154(b) by 0 days.

(21) Appl. No.: 09/498,131

(22) Filed: Feb. 3, 2000

(30) Foreign Application Priority Data

Feb. 4, 1999 (GB) ..... 9902436

(51) Int. Cl.[7] ..... E21B 33/127
(52) U.S. Cl. ..... 166/387; 166/187; 166/191
(58) Field of Search ..... 166/387, 187, 166/191

(56) References Cited

U.S. PATENT DOCUMENTS 672,475 * 4/1901 Cavallaro ..... 166/187
2,227,729 * 1/1941 Lynes ..... 166/187
3,393,744 * 7/1968 Fagg et al. ..... 166/187
3,915,227 * 10/1975 Simpson ..... 166/188
3,952,799 * 4/1976 Simpson ..... 166/116
4,063,427 * 12/1977 Hoffman ..... 166/187
4,968,184 * 11/1990 Reid ..... 405/225
5,048,605 9/1991 Toon et al. ..... 166/187
5,184,677 * 2/1993 Dobscha et al. ..... 166/187
5,195,583 3/1993 Toon et al. ..... 166/187
5,392,853 2/1995 Toon ..... 166/187

* cited by examiner

*Primary Examiner*—Hoang Dang
(74) *Attorney, Agent, or Firm*—Anthony Asquith & Co.

(57) ABSTRACT

The packer includes the usual outer bladder, which is inflated against the sides of the borehole, to seal around a work-pipe. But the packer also includes an inner bladder. The packer is mechanically secured to the work-pipe by the grip of the inner bladder around the work-pipe. The inner bladder is sucked outwards by a vacuum pump, to enable the packer to be moved along the work-pipe. The same port through which vacuum was admitted to the inner bladder can then be used to admit pressurized fluid to the outer bladder.

19 Claims, 15 Drawing Sheets

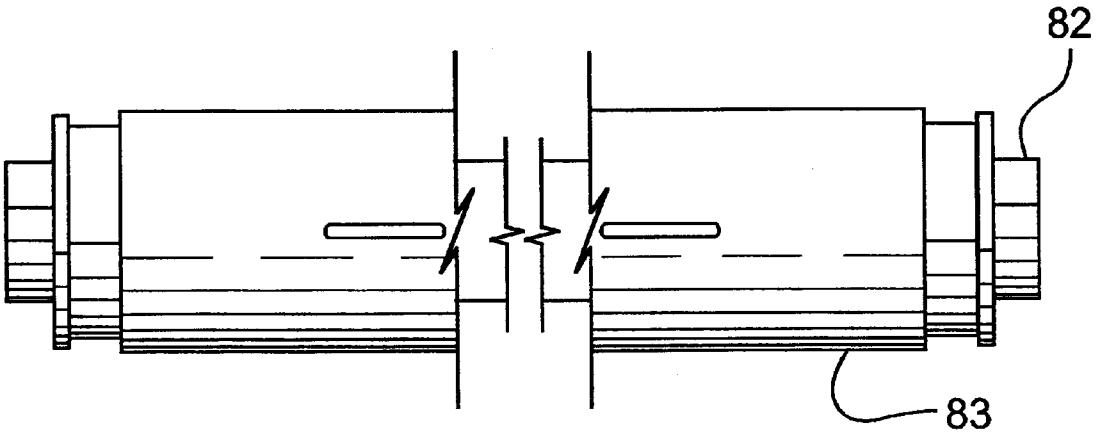
FIG.13A1
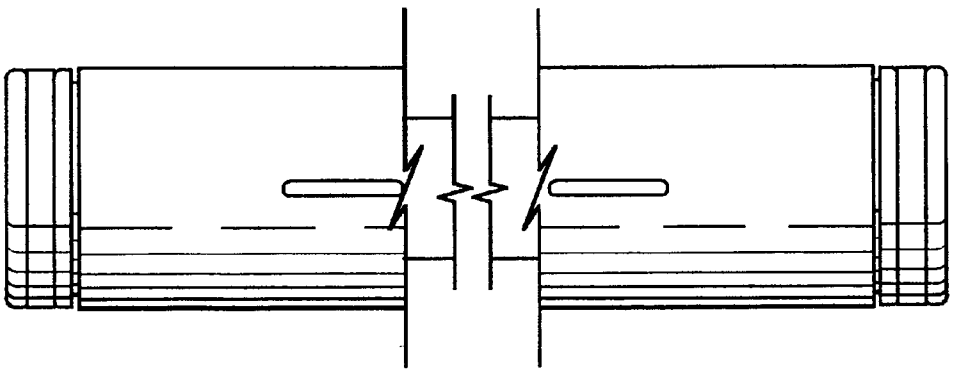
FIG.13A2

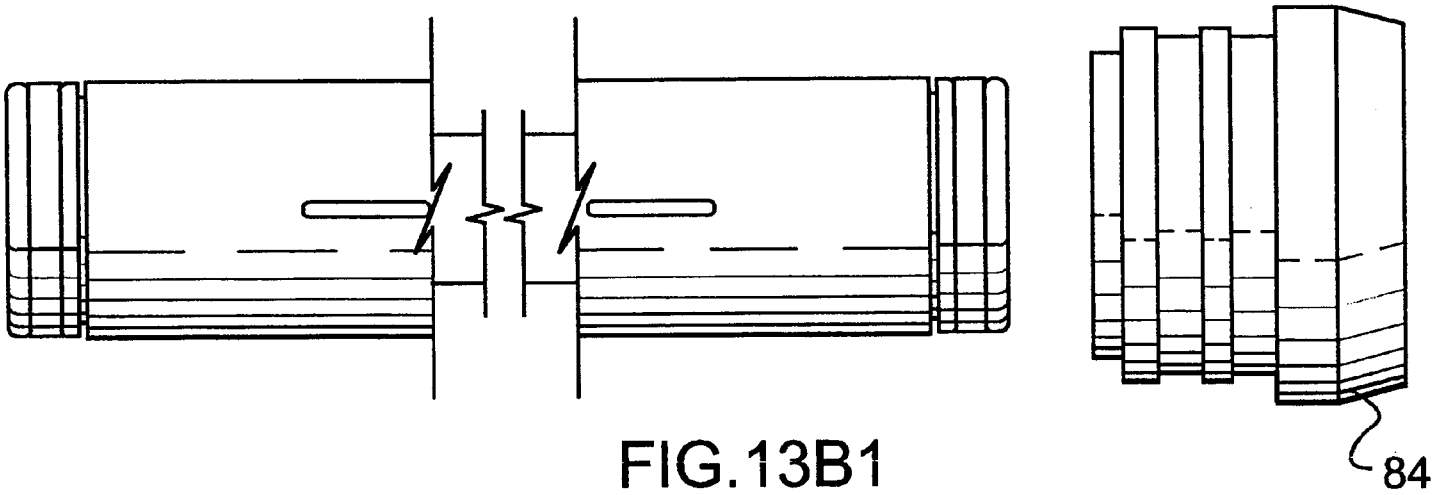
FIG.13B1
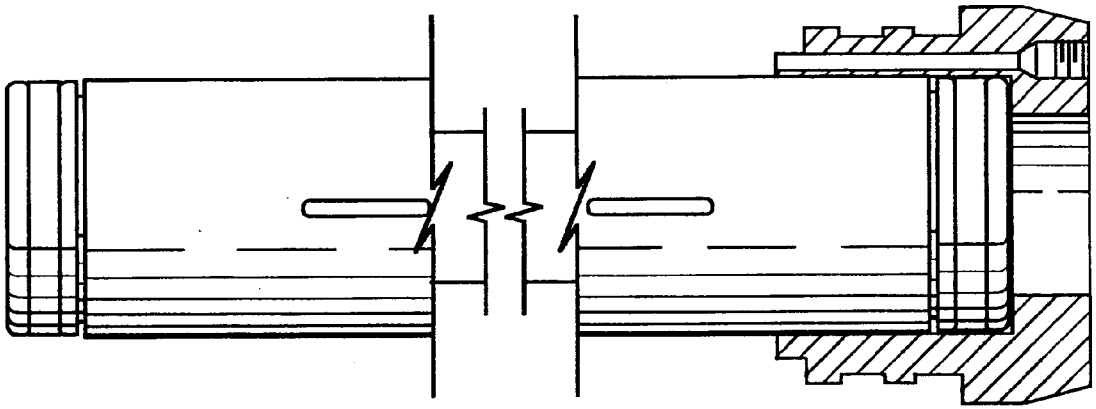
FIG.13B2

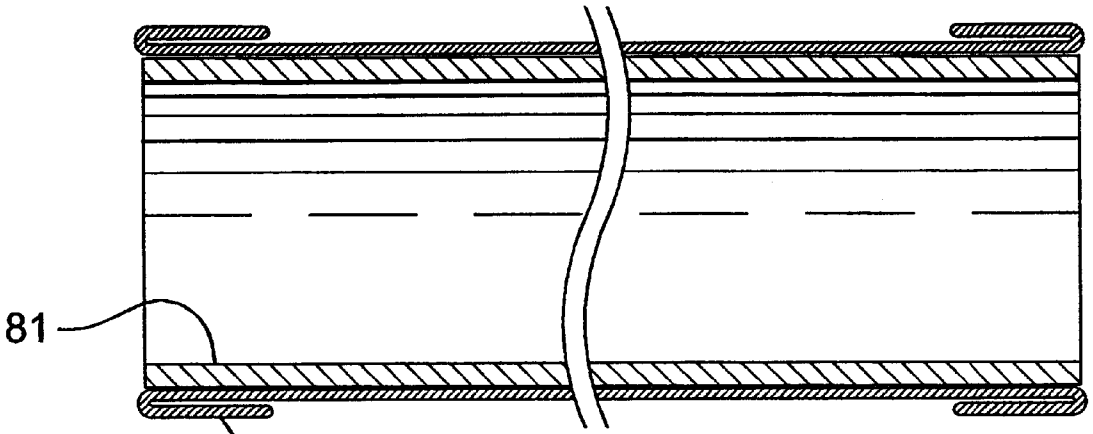
FIG. 13C1
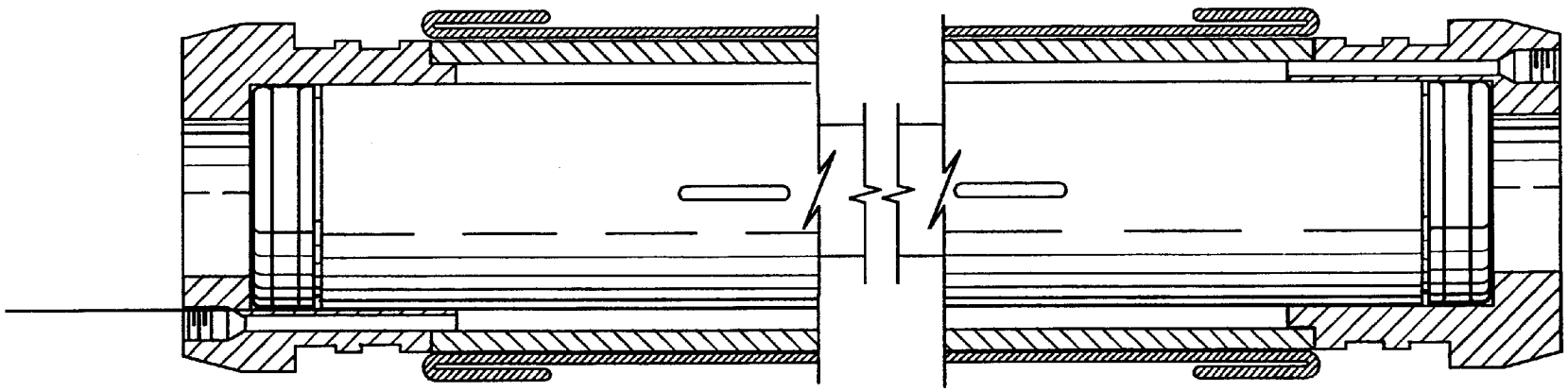
FIG. 13C2

PACKING SYSTEM AND METHOD FOR BOREHOLES

It is common practice to pass a work-pipe down into a borehole, from the ground surface. The work-pipe may be designed to serve one of many different functions, for example to convey samples taken at various depths to the surface.

The invention relates to borehole packers, of the kind used to seal the annular gap a between the work-pipe and the borehole wall or casing.

The purpose of a borehole packer is to bridge and seal the annular, radial, gap between the work-pipe and the borehole. Generally, the construction of the work-pipe, and the placement of the packers on the work-pipe, is done at the ground surface, prior to a lowering the work-pipe and packers, as an assembly, down the borehole. The on-site engineer determines the depth at which he wishes to take the water sample; he arranges the work-pipe so as to include a water-draw-off sampling-port at the desired depth; then he arranges for packers to be placed above and below that depth.

Usually, the process of lowering the assembly of work-pipe and packers into the borehole requires that the packers be deflated at that time. The packers are inflated, from the ground surface, once the packers are deployed at the desired depth. One technique is to employ, in the packer, bentonite or other material that swells upon contact with water. An example of that is shown in USA patent publication U.S. Pat. No. 5,195,583. The bentonite is slowacting enough that the packer remains slim during lowering, but swells to fill the annular gap over the next several hours or days. However, a bentonite packer basically cannot be removed, once deployed, as there is no way of deflating the bentonite packer.

Deflatable packers generally include a means for pressurising the packer from the surface, and deflation involves releasing that pressure, again from the surface. An example of that is shown in USA patent publication U.S. Pat. No. 5,392,853. The packers having been deflated, the work-pipe and packers can be withdrawn from the borehole, whereupon the borehole can be sealed up, and the work-pipe and packers can be re-used in a different borehole.

Deflatable packers have not, traditionally, been of a simple nature. The invention is aimed at providing a deflatable packer that is simple to deploy, is versatile in accommodating onsite requirements, is easy to operate, is robust in construction, is economical to produce, and is trouble-free in service.

Other examples of relevant prior art structures are contained in USA patent publication U.S. Pat. No. 5,048,605.

GENERAL FEATURES OF THE INVENTION

The packers have to be attached to the work-pipe at the ground surface, prior to the assembly of work-pipe and packers being lowered down the borehole The packers must therefore be securely attached with respect to the work-pipe. Traditionally, this requirement has been met by building the packer mechanically into the work-pipe, as a component of the work-pipe. If not built-in, at least the traditional packer has included a structural component whereby the packer could be mechanically attached, e.g with screw fasteners or the like, to the structure of the work-pipe.

One of the problems with traditional built-in packers is that the packer cannot be moved along (i.e up/down) the work-pipe to a new location; rather, the work-pipe has to be rebuilt if the packer needs to be moved Another problem with the built-in packer is that the packer itself is manufactured and assembled, as a unit, in-factory, but the packers are assembled into the work-pipe in the field, i.e at the borehole site. The packer has to be designed and manufactured to suit the dimensions and other details of the fittings already present on the work-pipe, such as screw-threads, port sizes, etc. It is, unfortunately, all too common to find, for instance, when the attempt is made to screw the packer into the work-pipe, that the screw-threads are the wrong size.

The present invention provides a packer in which the packer is secured to the work-pipe, not by mechanical connection, but by the action of a rubber inner-bladder, which encircles the work-pipe. The packer structure includes solid components, but these components do not come into contact with the work-pipe. In the invention, there is no need for mechanical connections, such as screw threads, between the packer and the work-pipe. The solid components of the packer are mounted, not directly from the work-pipe, but indirectly from the work-pipe, via the inner bladder.

The only information that is needed in order to custom-make the packer to suit the on-site work-pipe, then, is the diameter of the work-pipe. The inner bladder comprises a length of stretchy rubber tubing, which is arranged to be of a diameter that is slightly smaller than the work-pipe, so the inner bladder will grip the work-pipe.

In order to allow the packer to be moved along the work-pipe, for assembly and positioning purposes in the field, a vacuum source is provided, and vacuum is applied around the outside of the inner bladder. The vacuum sucks the inner bladder outwards, and thereby increases the clearance diameter inside the inner bladder. With the inner bladder held dear of the work-pipe, the packer can be moved along the work-pipe. Once the packer is in position, the vacuum is released, and the inner bladder then relaxes, and contracts. The inner bladder grips the work-pipe along its length. Only a small degree of residual stretch is needed for the packer to be secured very firmly to the work-pipe.

In practice, if more security is needed than is given by the bladder alone, suitable abutment clamps can be secured around the work-pipe, above and below the packer. The abutment clamps make sure that the packer, even if it is knocked during assembly and installation, cannot move along the work-pipe.

The vacuum source is provided for moving the packers around on the work-pipe, prior to lowering the assembly of work-pipe and packers down the borehole. Generally, the vacuum source is not used again, once the work-pipe and packers have been assembled and installed to their final working depths, in the borehole.

The packer also includes an outer bladder, which is able to be expanded by the application of pressure inside. An operable pressure source is provided, and once the packer or packers are in place on the work-pipe, the pressure source is connected. When the assembly of work-pipe and packers has been lowered into position, the pressure source is operated, which expands the outer bladder, and expands it far enough to bridge the gap between the work-pipe and the casing of the well or borehole. Thereafter, until the time comes for the assembly of work-pipe and packers to be removed from the borehole, the pressure source stays operated, maintaining pressure on the outer bladder.

Preferably, the inner bladder is also subjected to pressure, whereby the grip of the inner bladder upon the work-pipe is enhanced. If only the outer bladder is pressurised, there can be a chance that the in-ground water pressure will dislodge the inner bladder from the work-pipe.

To remove the assembly from the borehole, the pressure is removed, whereby the outer bladder collapses inwards, and breaks contact with the walls of the borehole. Generally, the vacuum would not be applied while the assembly is down the hole (although it could be, to make sure the outer bladders are well-collapsed before an attempt is made to remove the assembly from the borehole); once the assembly is out of the borehole, vacuum can then be applied to the packers, to enable them to be repositioned on, or removed from, the work-pipe, as required.

As mentioned, a major benefit of the packer as described herein is that it can be moved along to a new position on the work-pipe, without breaking the work-pipe; but this cannot be done with a deflatable packer that has been mechanically built into the work-pipe. Another major benefit of the packer as described herein is that a correct size of deflatable packer can be supplied from the factory, simply upon knowing the diameter of the work-pipe; but when the packer was built into the work-pipe, the supplier of the packer had to know other details, such as screw thread sizes, wall thickness, etc.

DETAILED DESCRIPTION OF PREFERRED EMBODIMENTS

By way of further explanation of the invention, exemplary embodiments of the invention will now be described with reference to the accompanying drawings, in which:

FIGS. 3A,3B,3C,3D show four stages in the deployment of the system of FIG. 2.

Figure 7:
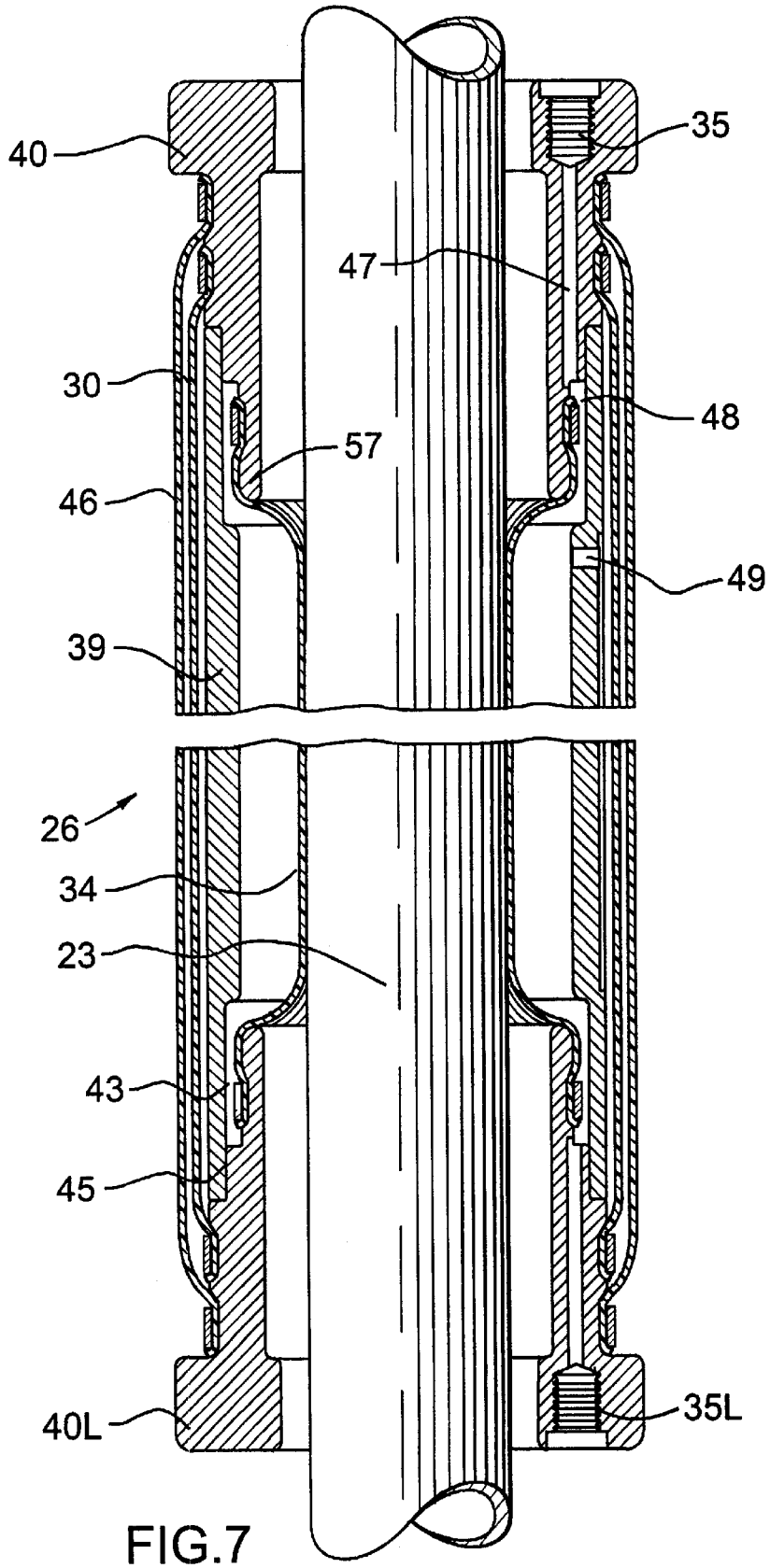
FIG. 7 is a cross-section in detail of the assembled packer.
Figure 7A:
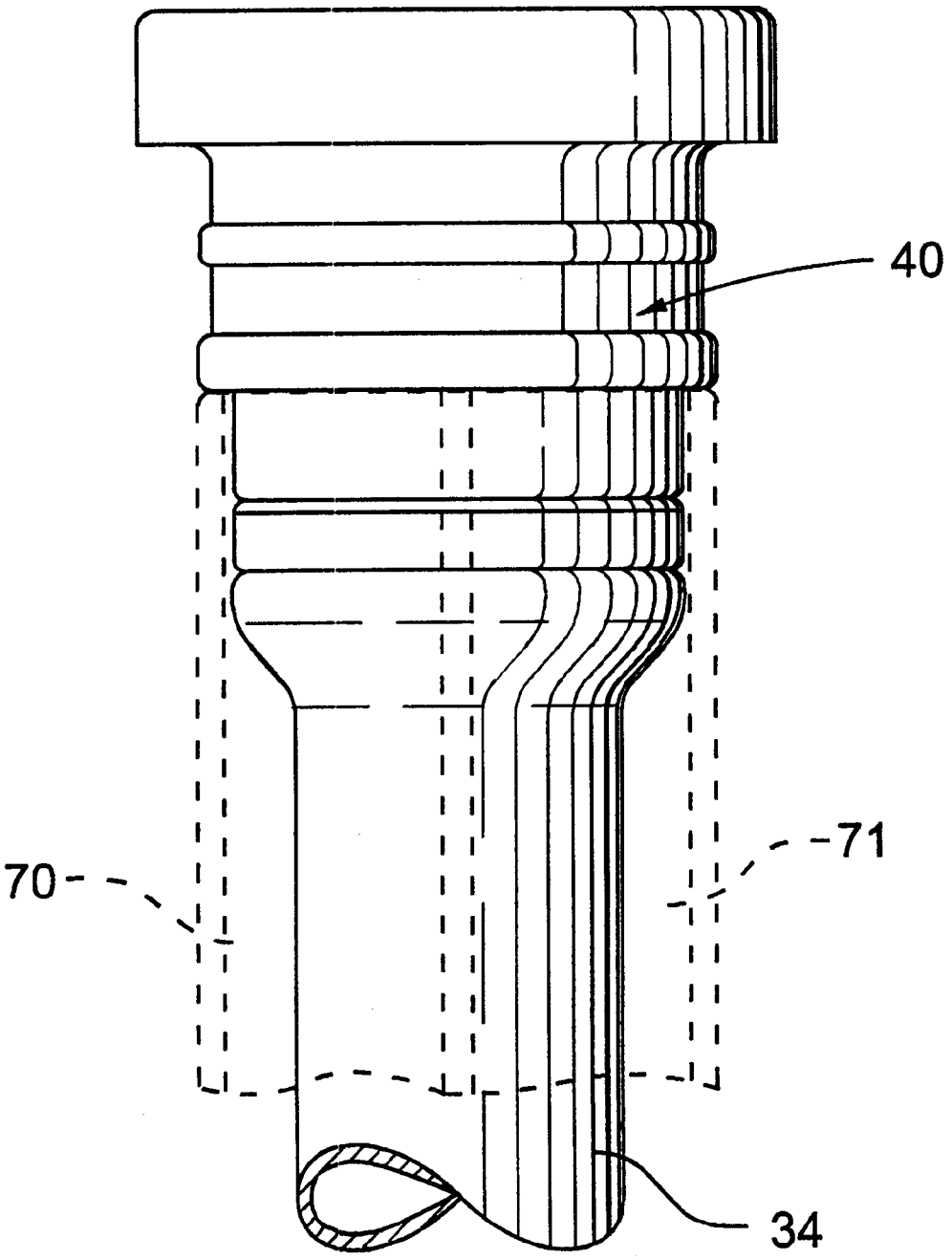

FIG. 7*a* shows a modification to the embodiment of FIG. 7.

Figure 8C:
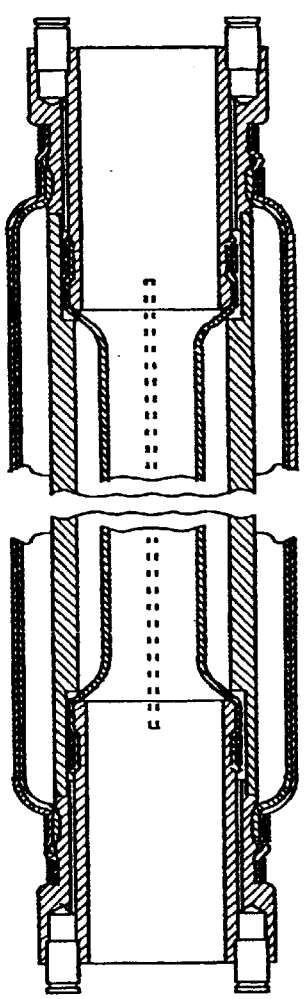
Figure 8B:
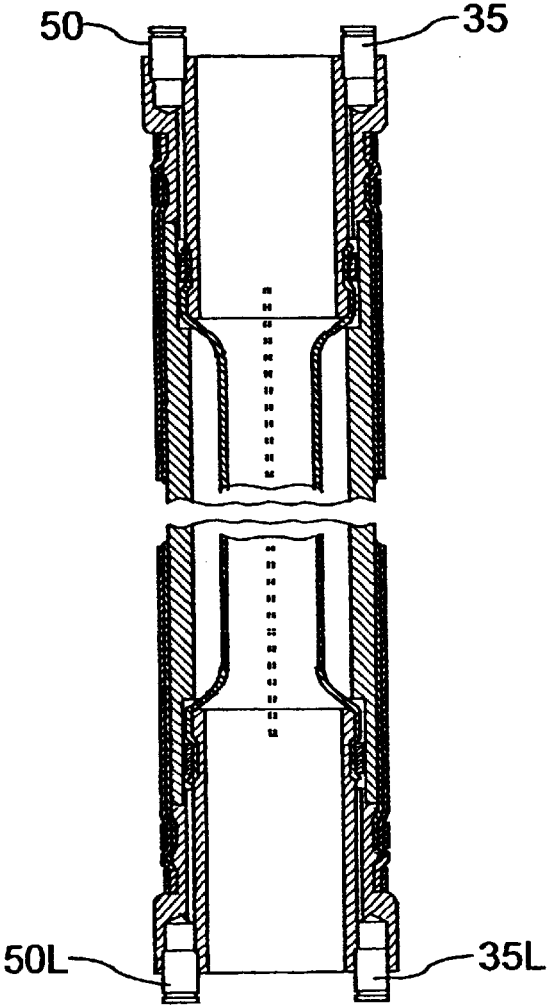
Figure 8A:
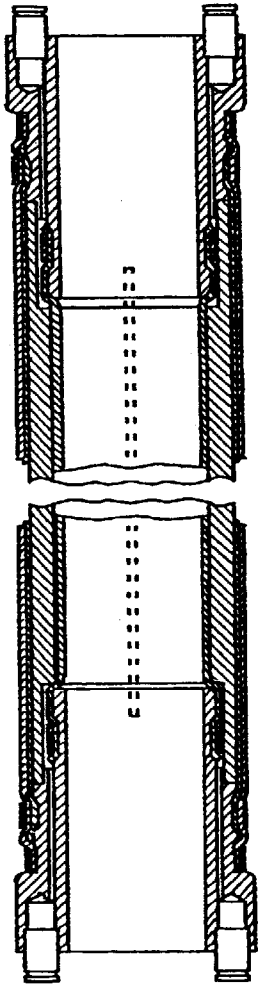

FIGS. 8A,8B,8C show a packer, having double inflation port; in three stages of operation.

Figure 9:
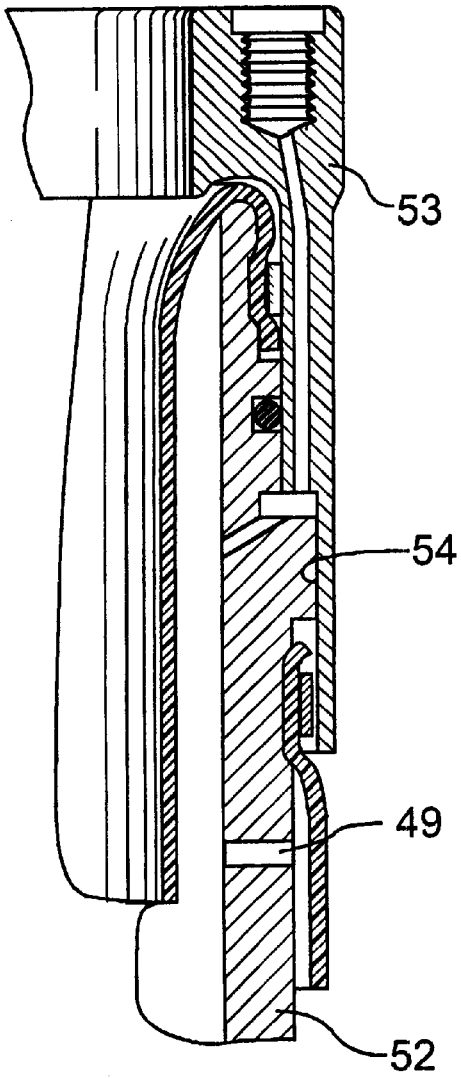

FIG. 9 is a cross-section corresponding to an area of FIG. 7, of another construction of packer.

Figure 10:
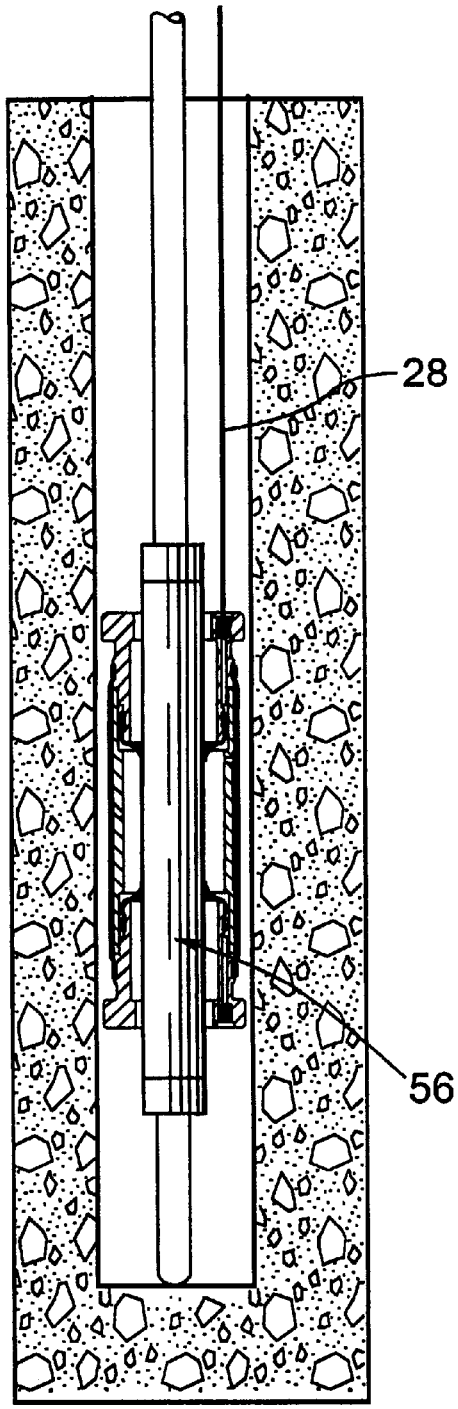

FIG. 10 shows a packer deployed around a pump body, in a borehole.

Figure 11:
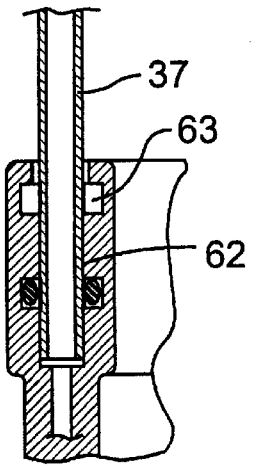

FIG. 11 shows another way of arranging the inflation ports of the packer.

Figure 12:
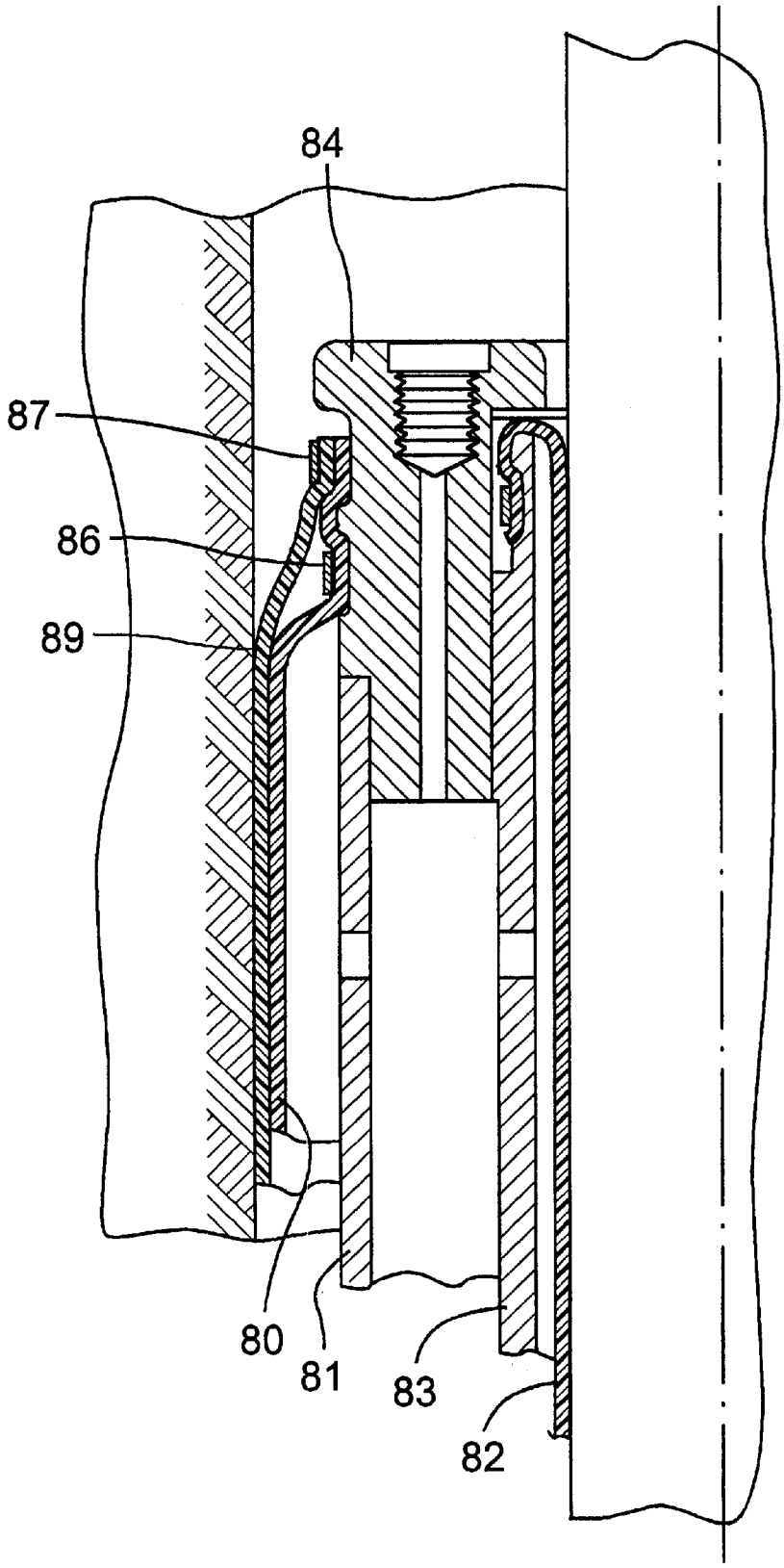
Figure 13D:
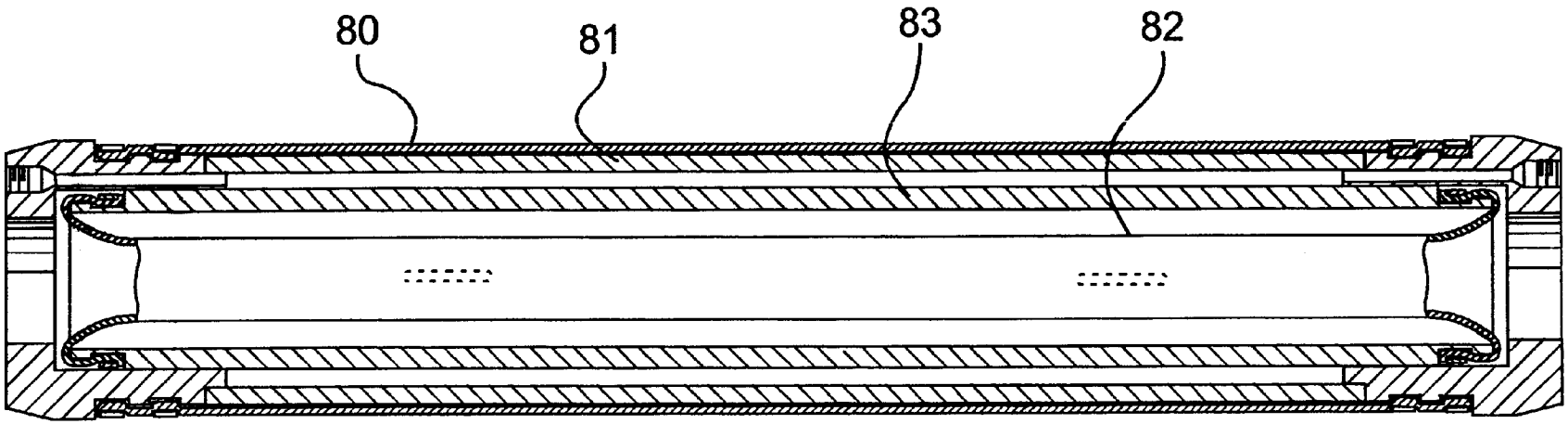

FIG. 12 is a cross-section of an area of another packer that embodies the invention;

FIGS. 13A1, 13A2, 13B1, 13B2, 13C1, 13C2, 13D show stages in the construction of the packer of FIG. 12.

Figure 14:
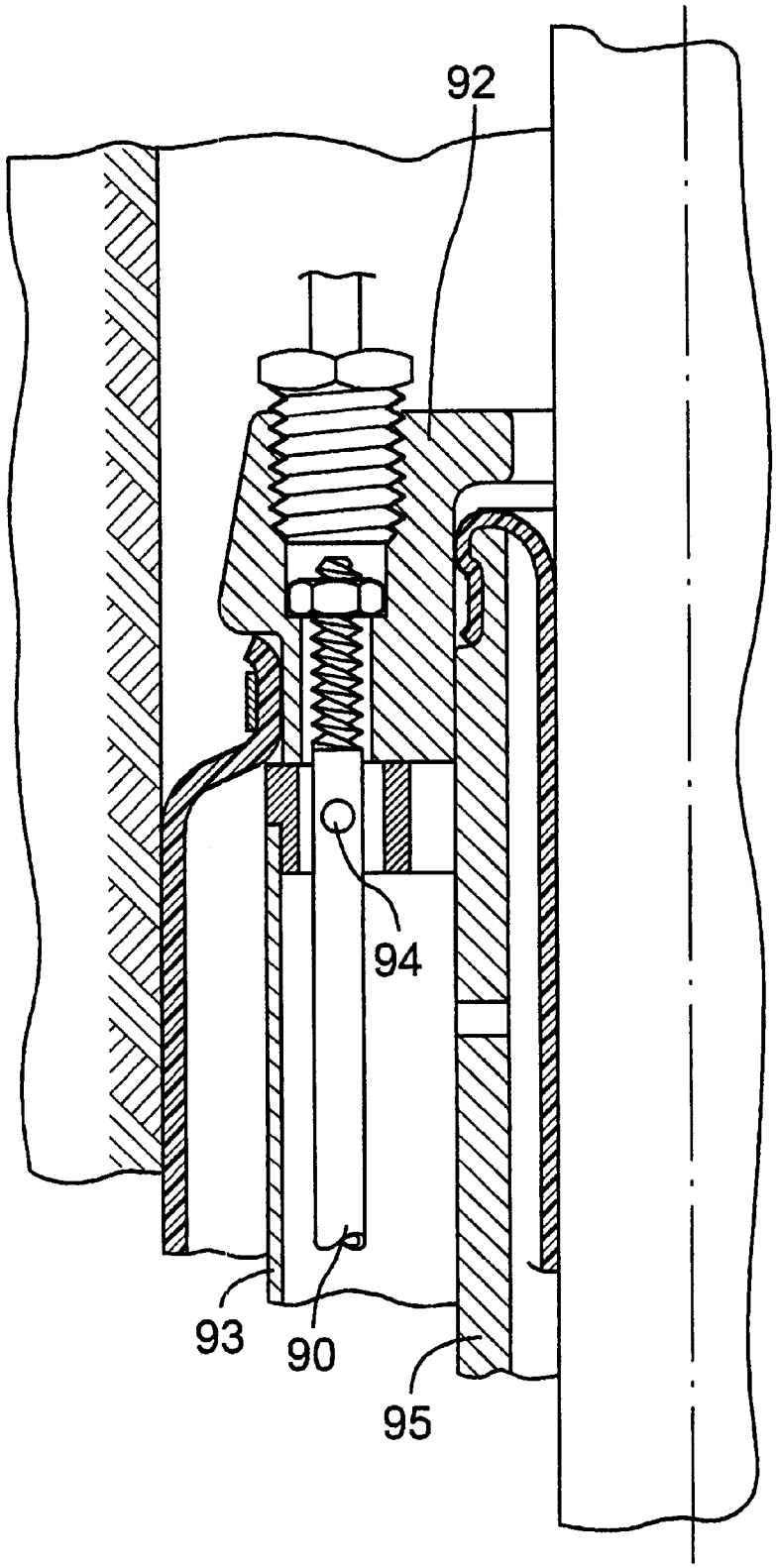
Figure 15A:
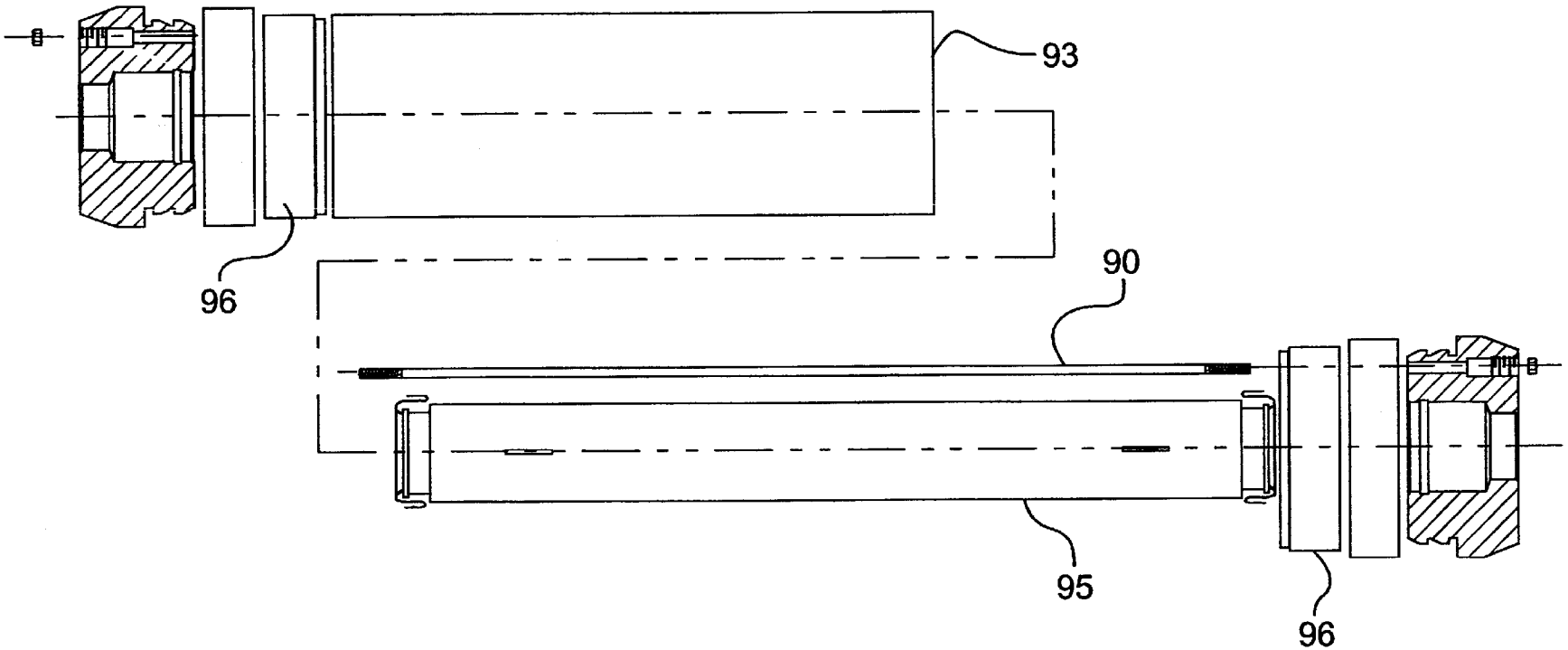
Figure 15B:
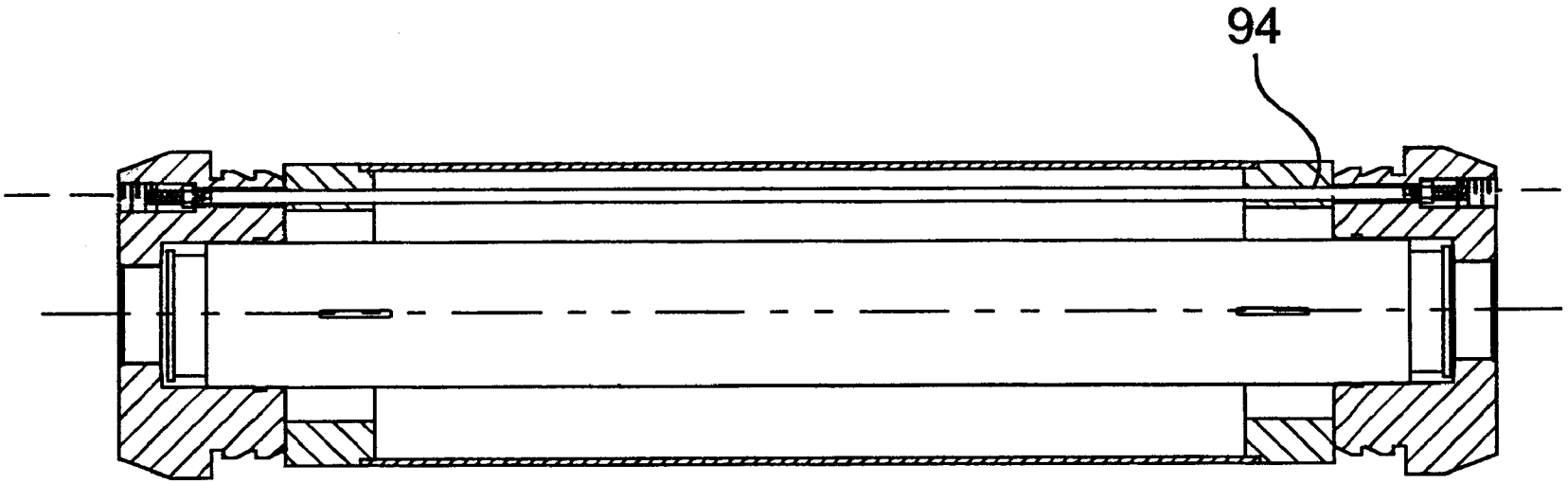

FIG. 14 is a cross-section of an area of another packer that embodies the invention;

FIGS. 15A, 15B show stages in the construction of the packer of FIG. 14.

The apparatuses shown in the accompanying drawings and described below are examples which embody the invention. It should be noted that the scope of the invention is defined by the accompanying claims, and not necessarily by specific features of exemplary embodiments.

Figure 1:
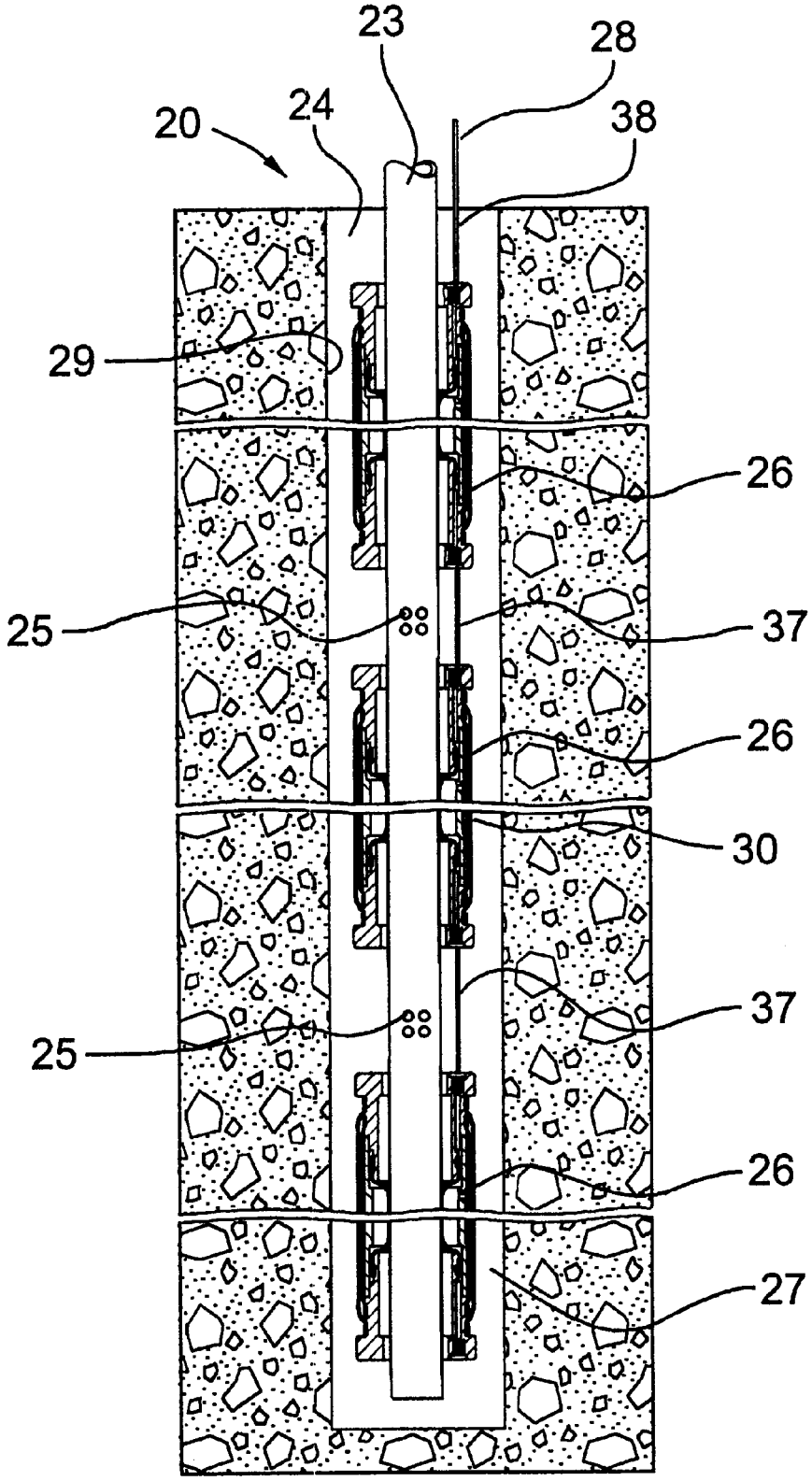
FIG. 1 is a cross-section of a borehole in the ground, showing the deployment of inflatable-deflatable packers that embody the invention.

FIG. 1 shows a well-sampling system 20, in which a work-pipe 23 passes down the centre of a borehole or well 24. Mounted on or in the work-pipe 23 are a number of water-sampling draw-off ports 25.

Packers 26 are provided, to seal the annular space 27 between the work-pipe and the borehole, in order that the engineer can be sure that water drawn from sampling ports 25 is water that comes from the depth at which the port is located, and is not water that has simply travelled up or down the well from some other depth. The packers 26 are provided between the sampling-ports, or above and below each sampling-port.

The packers 26 are inflatable. An inflation tube 28 runs down from the surface, and from packer to packer. Inflation chambers inside each packer are interconnected via the inflation tube, whereby every one of the packers is inflated when pressure is supplied from the surface. (By the same token, if there should be a leak in the inflation tube, or in one of the packers, then none of the packers can be inflated.)

The string of packers, attached to the work-pipe 23, can be inserted into the borehole 24, when the packers are in an un-inflated condition. Once the packers are inflated, the packers are firmly locked against the inwards-facing wall 29 of the borehole; that is to say, an outer bladder 30 of the packer expands into contact with the wall 29, with enough pressure to seal the packer against the wall.

Of course, where the bladder is sealing directly against a wall 29 of ground material such as bedrock or clay, the seal is not absolute, in that groundwater is seeping through the ground material. As mentioned, the purpose of the packer is to prevent the groundwater transferring up and down the borehole 24 itself, between the sampling ports. If the water can transfer between sampling levels by seeping through the ground material, of course that is the natural condition, and the sampling must take it into account. Where the inwards-facing wall 29 is the wall of a plastic or metal well-casing or liner, the seal the outer bladder 30 makes against the wall can be expected to be more nearly absolute. The friction arising from the pressure of the bladder against the wall serves also to lock the packer mechanically to the wall.

The inflation pressure should be maintained constantly. If the pressure were allowed to fall, the outer bladders 30 of the packers 26 would break contact with the wall 29, and then groundwater could transfer up/down the borehole, between sampling levels. (The packers are supported on the work-pipe 23, even when deflated, and so would not fall down to the bottom of the borehole, if the inflation pressure were not maintained.)

After a sampling exercise at the borehole, which may take a few months, the packers 26 can be deflated, and the whole assembly of packers and work-pipe can then be removed, as an assembly, from the borehole. The borehole may then be grouted up, or otherwise dosed. The packers and work pipe can be transported to another borehole, and used again, or they can be rearranged and replaced in the same borehole.

Figures 2, 3:
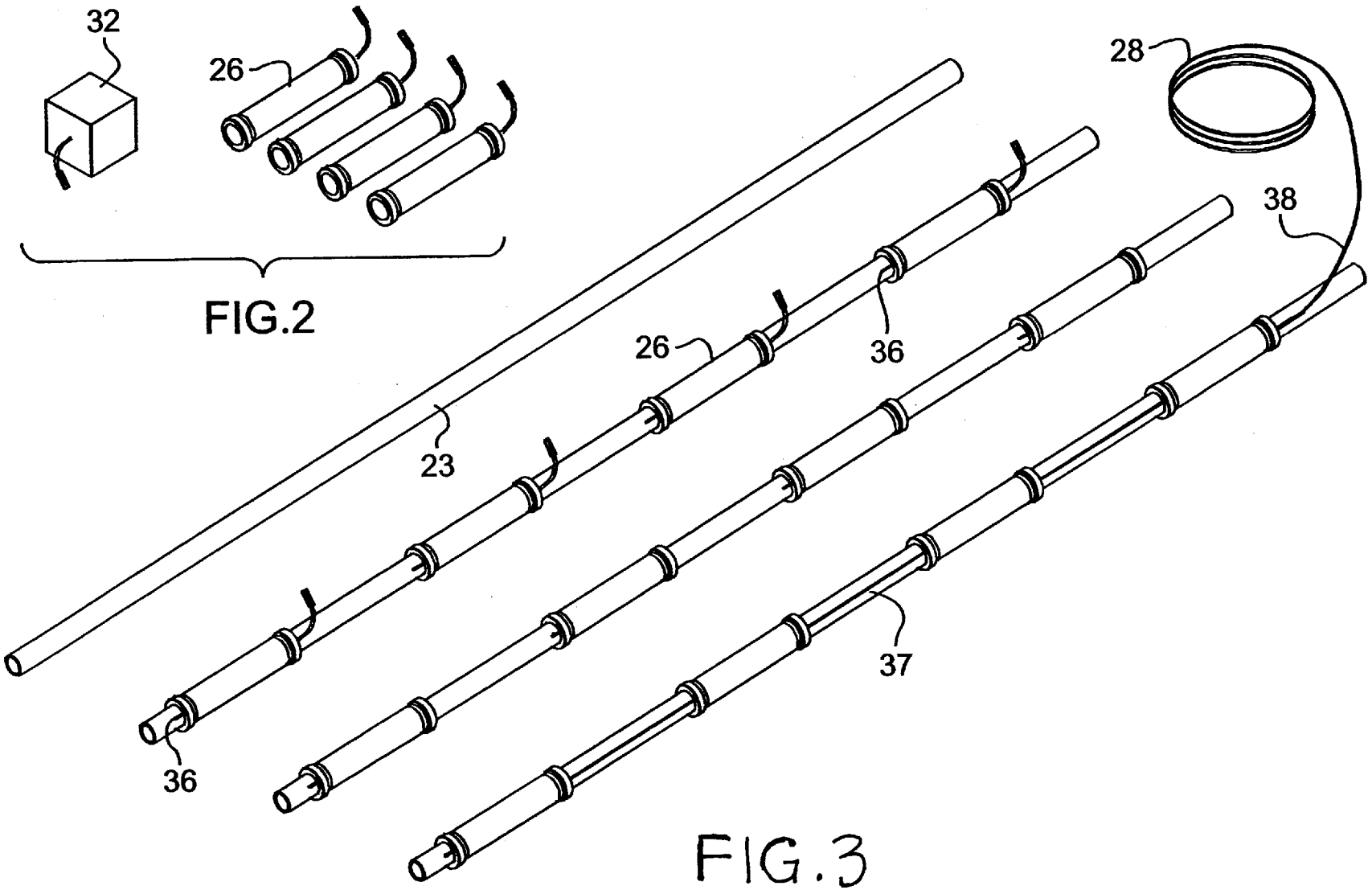
FIG. 2 is an illustration of some of the components that are needed in respect of a borehole packing system.

The manner of assembling the packers 26 onto the work-pipe 23 is shown in FIGS. 2 and 3. The work is done in the field, i.e on the ground near the open mouth of the borehole. First, the materials shown in FIG. 2 are assembled. That is to say: a work-pipe 23; a set of packers 26; a supply of flexible inflation tubing 28; and a vacuum source 32, which may be a hand-operated pump or the like.

It has already been determined as to what depths to place the sampling ports, and at what depths to place the packers 26. These depths may be marked off on the work-pipe 23. To enable the packer to be slid along the work-pipe, the packer must be evacuated of air. The on-site technician applies vacuum to the packer. The vacuum sucks an inner bladder 34 of the packer outwards. The packer can then easily be slid along the work pipe. The vacuum source can be disconnected, once the packer has been evacuated, if suitable operable connectors are installed in the fluid connection ports 35 of the packer 26 (FIG. 3B). Or the vacuum source can be left connected to the packer until the packer is in its final resting place on the work-pipe. FIG. 3B, shows the packers being manoeuvred into position along the work-pipe, each packer having suitable operable plugs 36, whereby the vacuum can be maintained or released. Depending on the design of the sampling ports 25, the sampling ports may require certain elements (not shown) of the structure of the sampling ports to be slid along the work-pipe, before being fixed in position at the port location. Of course, the technician should see to it that the sampling port elements (if such are needed) are assembled in sequence between the packers.

Once the packer is in its final position, the technician releases the vacuum (FIG. 3C). The inner bladder 34 relaxes, and settles down onto the work-pipe 23, and grips the work-pipe. The diameter of the inner bladder 34 is selected so that the inner bladder, when relaxed, is a little smaller than the work-pipe. The grip of the inner bladder on the work-pipe is tight enough to prevent the packer from further sliding along the work pipe, when the vacuum is released.

In FIG. 3C, the packers are neither inflated nor evacuated, and their respective inner bladders are relaxed, and gripping the work-pipe. Now, the technician measures the lengths of inflation pipe needed, to connect between each pair of packers. The inflation pipe 28 is of suitable plastic or stainless steel tubing, e.g 4 mm nylon tubing, which can be cut with a knife. The pieces 37 of inflation pipe are connected between the upper and 24 lower connection ports 35 of the packers (FIG. 3D). Now, the assembly comprising the work-pipe, with sampling ports 25, and with attached packers 26, is ready to be lowered down the borehole. The bladder chambers preferably should be pre-filled with water, prior to installation. At the top of the work-pipe, a surface-length 38 of inflation pipe enables the inflation pipe system to be connected to a suitable pressurisation or inflation means, at the surface.

The connection ports 35 may be fitted with conventional push-to-insert, poke-to-release, type of connections. These contain means for sealing the inflation tubing 28 into the port, and retaining the tubing mechanically in the port.

In a water-filled borehole, generally the packers should be inflated with water. The pressure of groundwater increases with depth (more or less linearly, except under very unusual water table conditions), whereby the head of pressure, i.e the head between the water in the packers and the groundwater in the borehole, that is present at the water table is present all the way down the borehole. If the packers were to be inflated with air, the pressure in the packers would have to be enough to inflate the bottom-most packer, against the groundwater pressure it faces, which might lead to the upper packers being over-inflated and perhaps damaged.

The inflation fluid, i.e water, is fed into the top of the inflation tubing, at the ground surface. The water descends, and progressively fills up the packers, inflating the outer bladders thereof. When the inflation tubing, and all the packers, are full of water, a head of water can be maintained in the tubing by disposing the surface-length 38 of the tubing enough meters above the water table to maintain the desired head of pressure. The pressure head imposed on the water in the packers should be enough to overcome the elasticity of the outer bladders 30, and inflate same into contact with the inside-facing wall 29 of the borehole. If it is inconvenient to leave the length 38 of the inflation tubing at a height above the ground, the pressure in the tubing can be maintained by the use of a suitable pressure pump, or by applying a pressurised gas bottle to the water, with a suitable pressure regulator.

The construction of one of the packers is shown in FIGS. 4–7.

Figures 4, 5, 6:
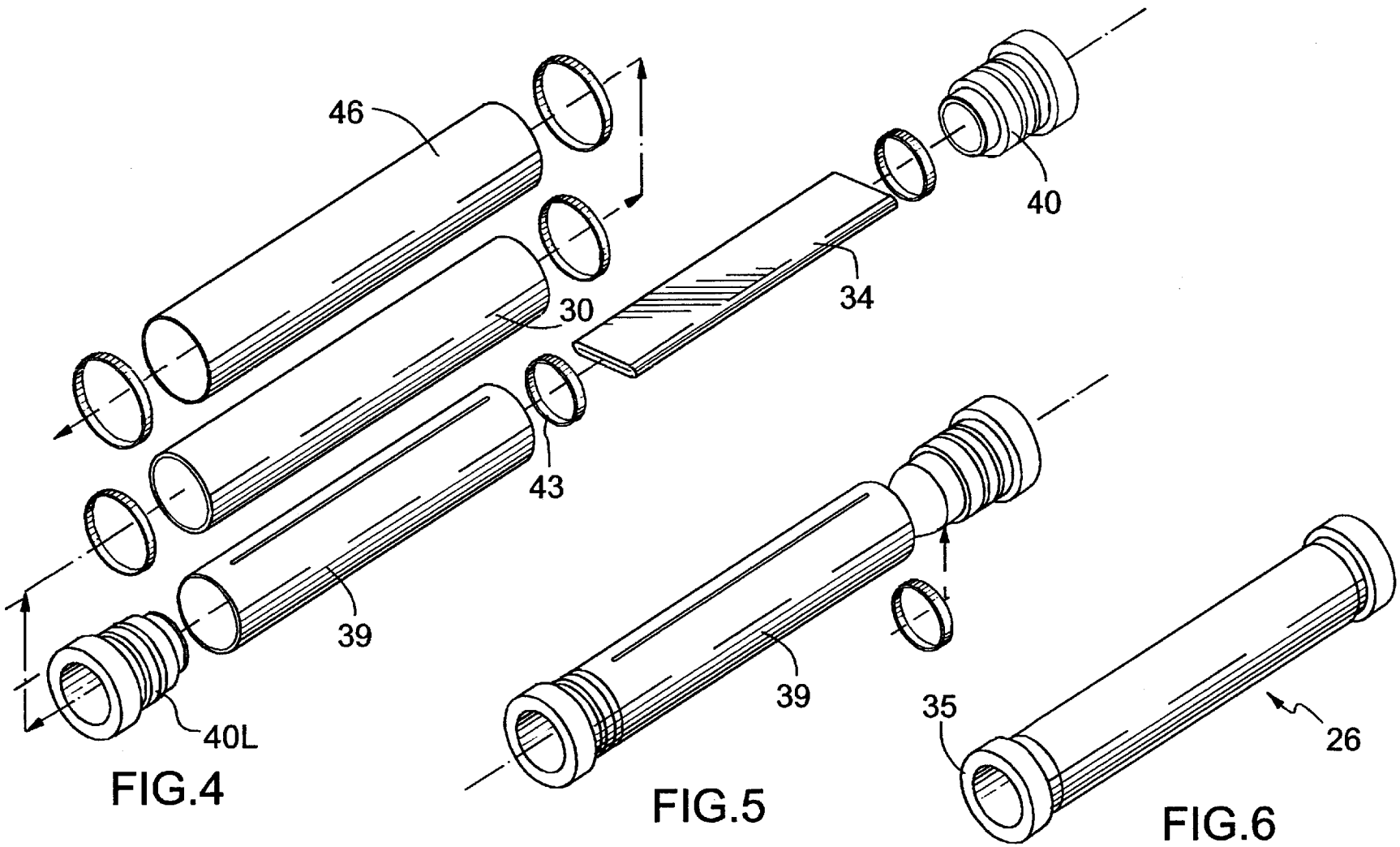
FIG. 4 is an illustration of some of the components of one of the packers of FIG. 2
FIG. 5 shows a stage in the construction of the packer of FIG. 4.
FIG. 6 shows a later stage in the construction.

The components of the packer are shown in FIG. 4. The packer includes a central support tube 39, of plastic (or it could be stainless steel if the application requires it). Inside the support tube 39 is the inner bladder 34, which comprises a length of thin, stretchy rubber tube. The inner bladder 34 is attached at its upper end to an upper end-piece 40, and at its lower end to a lower end-piece 40L. The two (identical) end-pieces are machined from plastic (or stainless steel. The inner bladder 34 is stretched over the end pieces 40,40L and clamped to the nose 57 on the end pieces. The clamp 43 is such as to seal the inner bladder against fluid leakage, and to secure it mechanically.

The operator first clamps the inner bladder to the lower end-piece 40L. Then he inserts the inner bladder 34 lengthwise into the support tube 39. Then, he pulls the upper end of the inner bladder through the support tube. It will generally be necessary for him to stretch the rubber inner bladder lengthwise (i.e axially) to do this. He must also stretch the upper end of the inner bladder circumferentially, to enable the upper end of the bladder to fit over the upper end-piece 40, prior to being clamped thereto.

Once the inner bladder 34 is clamped to both the upper and lower end-pieces 40,40L, the inner bladder will naturally draw the two end-pieces together, onto the ends of the support tube 39 (FIG. 5). The end-pieces 40,40L are then cemented to the ends of the support tube, at 45.

It is not essential that the rubber inner bladder 34 should be stretched lengthwise, after the end-pieces are fixed into the support tube 39; however, if the inner bladder were to be left slack and loose in the support tube, the inner bladder might not be sucked outwards as a unitary whole.

The more the residual (axial) stretch that is to be left in the inner bladder 34, though, the harder it is for the operator to pull the inner bladder through the support tube, and then clamp the bladder to the upper end-piece. However, the use of appropriate jigs and fixtures on the assembly line simplifies that task.

As shown in FIG. 7*a*, the middle section of the support tube can be split lengthwise. The two halves 70,71 (shown ghosted in FIG. 7*a*) can then be assembled around the inner bladder 34, and around the end-pieces. The assembly of the two halves can be done after the inner bladder has been clamped to the end pieces; therefore, the inner bladder does not have to be stretched and pulled lengthways through the middle section of the support tube. When the support tube is split into two halves, also there is no need for a hole through the wall of the tube, for connecting the inner bladder chamber to the outer bladder chamber.

The outer bladder 30 comprises a tube, again made of thin stretchy rubber. The operator might stretch the outer bladder 30 over one of the end-pieces, and pull the outer bladder along the support tube 39. Alternatively, the outer tube can be placed in a vacuum chamber, in which the outer tube is sucked out, and held out, while it is assembled over the components of the packer. When the vacuum is released, the outer bladder settles down into contact with the support tube. With the outer bladder in place, the operator clamps the ends thereof to the upper and lower end-pieces 40,40L. The assembly of the packer is now as shown in FIG. 6. In some cases, the designer may prefer to add a second outer bladder 46, to protect the outer bladder 30 from being damaged by contact with the inwards-facing wall 29 of the borehole.

As shown in FIG. 7, inflation fluid is led into the packer through a fluid port 35 in the upper end-piece 40. A drilling 47 in the upper end-piece serves to convey fluid from the port to a chamber or space 48. The chamber 48 lies between the inner bladder 34 and the outer bladder 30. When inflation fluid enters the chamber 48, the inner bladder is forced inwards, and the outer bladder is forced outwards. A hole 49 through the wall of the support tube 39 ensures that the fluid can act upon both the inner and outer bladders.

The same fluid port 35 can also be used for evacuating the chamber 48. When the vacuum source 32 is applied to the fluid port 35, the outer bladder 30 is sucked inwards, against the outside surface of the wall of the support tube. The inner bladder 34 is sucked outwards, against the inside of the wall of the support tube 39, which enables the packer to be slid along the work-pipe 23. The outer and inner surfaces of the wall of the support tube may be grooved, as required, to ensure that when vacuum is applied, local areas of the bladders do not obscure the drilling 47 and the hole 49.

The lower end-piece of the packer has a similar port 35L. When applying the vacuum, only one port is used, and the other port is plugged. When the packers are installed on the work-pipe, the pieces 37 of the inflation pipes are connected between the packers, so both ports are used. The bottom-most packer of the string must have a plug in its bottom port.

When filling the packers with water, provision must be made for air to escape. If the inflation tubes are large, the air can bubble up the inflation tubes, as the water is passing down. However, 4 mm tubes are rather small for that, and preferably a second set of upper and lower ports 50,50L is provided in each packer, which also communicate with the respective chambers 48 in the packers. In FIG. 8A, the bladders are connected to the vacuum source, and any port not connected to the vacuum should be plugged. In FIG. 8B, the ports are all open, and the bladders at rest In FIG. 8C, the bladders are been filled with water, under pressure; water travels down through one of the upper ports 35, and air vents through the other upper port 50; water travels through and down to the next packer below through one of the lower ports 35L, and air from that packer below vents through the other lower port 50L, and eventually out through the upper port 50.

FIG. 9 shows another manner in which the bladders may be attached and sealed to the support tube of the packer. Here, the inner and outer bladders 34,30 are both clamped directly to the central support tube 52. The inner bladder is folded inside-out over the end of the support tube 52, prior to clamping. The end-pieces 53 are cemented, at 54, to the support tube after the bladders are clamped.

As was shown in FIGS. 3A,3B,3C, 3D, the assembly of work-pipe and packers is assembled at the ground surface, i.e the pipe is laid out horizontally along the ground. Then, the assembly is lowered down the borehole. Depending on the length of the assembled work-pipe, it is impractical to lift the whole assembly to the vertical, prior to entering the assembly into the borehole. Therefore, the assembled work-pipe must be flexible enough to permit it to be picked up from the (horizontal) ground, and fed into the (vertical) borehole progressively.

Sometimes, the work-pipe is not at all flexible—as in the packing system shown in the said U.S. Pat. No. 5,048,605, for example. In that case, the work-pipe is assembled progressively actually in the borehole. That is to say, the components are assembled to the pipe as the pipe is held up at the mouth of the borehole. The assembled portion is lowered into the borehole, and the other components then added above. When this is done, the inner bladder of the packer is vacuumed outwards, to enable the packer to be placed on, and adjusted as to its position on, the work-pipe. Once the packer is located in its correct position on the work-pipe, the vacuum is released, the vacuum source is disconnected, and the inflation pipes are fitted to enable the bladders to be pressurised.

FIG. 10 illustrates another advantage of the packer system as described herein. Some types of devices that are commonly inserted into wells and boreholes have an elongate cylindrical body. Bladder pumps, and probes of various kinds, are examples of this. Now, the inflatable packer 24, because it does not have to be built into the work-pipe, can simply be slipped directly over the body 56 of the device. Thus, the device can be sealed into the borehole without the need for extra components; that is to say, the work-pipe now is simply the body of the device itself.

The packers described above are typically about ½ meter in height, and are highly suitable for fitting into boreholes in the 5 to 15 cm range, over work-pipes in the 2 to 6 cm range of diameter, although other sizes are possible. The inflation pressure used to pressurise the bladders, during operation in the borehole, is typically 30 psi, but might need to be 100 psi in some cases.

FIG. 11 illustrates another way in which the connection lengths of the inflation tube can be deployed. Here, the connecting lengths of tubing 37 are pre-cut to the required length. The port 62 is simply a plain hole, with no provision for mechanically gripping the tubing. The lengths of tubing are manoeuvred into the port holes 62 while the vacuum is on, and while the packers can be moved along the work-pipe. Once the vacuum is released, the a packers cannot move, and so the lengths 37 are trapped. The surface length 38 of tubing should, however, be gripped mechanically, and a suitable fitting can be pressed into the port hole, and retained there by engagement with the groove 63. The same groove can be used to retain a plug in the port, where needed.

FIG. 12 shows an embodiment in which the annular distance between the work-pipe and the borehole is larger than before. The bladders can only expand so far without damage, and so it is advantageous for part of the wide annular gap to be filled by the solid structure of the packer, not by the expansion of the bladders. In FIG. 12, the outer bladder 80 collapses down onto an outer tube 81, and the inner bladder 82, when sucked outwards, contacts an inner tube 83. The diameters of these tubes can be tailored to suit the annular gap.

FIGS. 13A1, A2, B1, B2, C1, C2 and D show some of the stages in the assembly of the packer of FIG. 12. FIGS. 13A1,13A2 show the inner bladder 82 being folded over the ends of the inner tube 83. FIGS. 13AB1, 13B2 show the end piece 84 then being cemented onto the inner tube 83. FIG. 13C1 shows the outer bladder 80 in place over the outer tube 81. The outer bladder 80 was placed in a vacuum chamber, to expand it, prior to its assembly over the outer tube 81. FIG. 13C2 shows the subassembly of the inner bladder and inner tube being installed inside the subassembly of the outer bladder and outer tube. The ends of the outer bladder can now be unfolded, and clamped to the grooves in the end pieces 84.

As shown in FIG. 12, a supplementary outer bladder 89 is provided (as in FIG. 7). As shown, the outer bladder 80 is not only clamped at 86, but also the outer bladder is clamped inside the supplementary outer bladder 84, at 87. By this arrangement, any fluid that escapes the clamp seal at 86 cannot escape into the space between the outer bladder 80 and the supplementary outer bladder 89.

FIG. 14 shows an embodiment of a packer for a larger diameter of borehole. As the diameter of borehole increases, so the forces on the solid components of the packer (tending to pull them apart), from the pressurised bladders, increases. Cementing the end pieces onto the middle section of the support tube, as was done in the previous embodiments, cannot now be relied upon. The embodiment of FIG. 14 uses threaded rods 90 to hold the end pieces 92 together onto the outer tube 93.

The rods 90 are hollow, and the inflation fluid passes therethrough. One of the (three) rods is perforated, at 94, to allow communication with the inner and outer bladder chambers. For a string of packers, all the packers are connected with their perforated rods linked together. The bottom-most packer has all its rods perforated (and its bottom port plugged). For filling the bladders with water, the water is fed down the un-perforated rods, so the water descends to the bottom-most packer, and then fills the rest of the string of packers from the bottom up, which minimises the volumes of air left trapped inside the packers.

FIGS. 15A, 15B show some of the stages in the assembly of the packer of FIG. 14. In FIG. 15A, the inner bladder has been assembled to the inner tube 95. Spacers 96 have been slipped into the ends of the outer tube 93. The hollow threaded rods 90 are used to clamp the end pieces 92 together, i.e onto the outer tube 93. (The inner tube 95 can float lengthways, slightly, between the end pieces.)

Since no cement has been used in its construction, the packer of FIG. 14 can be dismantled, if desired.

In all the embodiments, air should be cleared out of the bladders prior to lowering the assembly of work-pipe and packers down the borehole. All the spaces in the bladders, and the bladder chambers, when the bladders are at rest, preferably should be pre-filled with water. It is disadvantageous for air to be trapped in the bladders, because pressurised air tends to migrate through rubber material over time, plus the volume of the air can change with temperature, all of which can make it harder to maintain consistent conditions.

It can also be advantageous, not only to pre-fill the at-rest bladder chambers with water, but actually to impose a small pressure on this water. The inner bladder may be made of thinner rubber than the outer bladder, whereby the inner bladder will be pressurised against the work-pipe, with this small pressure, before the outer bladder has started to expand. A pressure of say 5 psi is typically enough to help the inner bladder grip the work-pipe, without causing any expansion of the outer bladder.

What is claimed is:

1. Annular packer apparatus, for packing the hollow annulus between the outwards-facing wall of a work-pipe, and the inwards-facing wall of a borehole casing, wherein:

the apparatus includes a generally cylindrical, hollow, support-tube, of relatively rigid material, the support-tube having an upper end and a lower end;

the apparatus includes an outer bladder, comprising an outer tube of stretchy elastomeric a material;

the outer bladder is located outside the support-tube, its location being such as to create an annular outer space between the inside surface of the outer bladder and the outside surface of the support tube;

the outer bladder is sealingly fastened, at its upper and lower ends, to the support tube;

whereby the outer space forms a sealed outer chamber, between the outer bladder and the support tube;

the apparatus includes a means for communicating pressurised fluid into the outer chamber, the apparatus includes an inner bladder, comprising an inner tube of stretchy elastomeric material;

the inner bladder is located inside the support-tube, its location being such as to create an annular inner space between the outside surface of the inner bladder and the inside surface of the support tube;

the inner bladder is sealingly fastened, at its upper and lower ends, to the support tube;

whereby the inner space forms a sealed inner chamber, between the inner bladder and the support tube;

and the apparatus includes a means for communicating vacuum to the inner chamber.

2. Apparatus of claim 1, wherein the means for communicating vacuum to the inner chamber includes a fluid port, which is located in the support tube.

3. Apparatus of claim 1, wherein the means for communicating pressurised fluid to the outer chamber includes an upper fluid port, which is located in the support tube.

4. Apparatus of claim 3, wherein the apparatus includes, in addition to the upper fluid port for communicating pressurised fluid into the upper end of the outer chamber, also a lower fluid port, for communicating pressurised fluid in the outer chamber downwards out of the lower end of the outer chamber.

5. Apparatus of claim 1, wherein:

the means for communicating vacuum to the inner chamber includes a fluid port, which is located in the support tube;

the means for communicating pressurised fluid to the outer chamber includes an upper a fluid port, which is located in the support tube;

the inner chamber is in fluid-flow-communication with the outer chamber, whereby, when the fluid port is supplied with vacuum, both the inner chamber and the outer chamber are evacuated, and when the upper fluid port is supplied with pressurised fluid, both the inner chamber and the outer chamber are pressurised.

6. Apparatus of claim 5, wherein:

the apparatus includes an operable pressure source means, for supplying fluid under pressure to the upper fluid port, in such manner as to cause the outer chamber to be pressurised, and thereby to cause the outer bladder to be inflated outwards, away from the support-tube, and to be inflated at such pressure as to cause the outer bladder to expand and to make sealing contact with the inwards-facing wall of the borehole;

the apparatus is so structured and arranged that, when operation of the pressure source ceases, the outer chamber becomes deflated, and the outer bladder collapses inwards.

7. Apparatus of claim 5, wherein:

the apparatus includes an operable vacuum source means, for supplying vacuum to the fluid port, in such manner as to cause the inner chamber to be evacuated, and deflated, and thereby to cause the inner bladder to be sucked outwards, towards the support-tube;

the apparatus is so structured and arranged that, when operation of the vacuum source ceases, the inner bladder collapses inwards.

8. Apparatus of claim 7, wherein the apparatus includes means for plugging one of the fluid ports when vacuum is applied to the other fluid port.

9. Apparatus of claim 5, wherein:

at least one of the fluid ports includes a push-in-to-engage connection means;

the said connection means is structurally suitable for receiving the end of a length of plain tubing;

the connection means includes means for gripping the tubing mechanically, to prevent the tubing from coming out of the port;

the connection means includes means for making a fluid-tight seal between the tubing and a the port.

10. Apparatus of claim 1, wherein the support tube comprises a middle tube and upper and lower end pieces, all of solid rigid material.

11. Apparatus of claim 10, wherein:

the end pieces include respective noses, which are located inside the middle tube, and which extend towards each other;

the noses are formed with respective outward-facing inner-bladder attachment surfaces;

the apparatus includes means for clamping the ends of the inner bladder, one to each of the attachment surfaces.

12. Apparatus of claim 10, wherein the middle tube of the support tube comprises separable left and right halves, which can be assembled laterally around the inner tube, and laterally around the upper and lower end-pieces.

13. Apparatus of claim 10, wherein:

the middle tube of the support tube is one of an inner middle tube or an outer middle tube;

the inner middle tube is separate from, and inside, the outer middle tube;

the inner bladder lies inside the inner middle tube, and the outer bladder lies outside the outer middle tube.

14. Apparatus of claim 10, wherein the end pieces are secured to the middle tube by being cemented thereto.

15. Apparatus of claim 10, wherein the apparatus includes threaded rods, for clamping the middle tube of the support tube between the upper and lower end-pieces.

16. Apparatus of claim 15, wherein the threaded rods are hollow, and are arranged to conduct fluid from the upper end piece to the lower end piece.

17. Apparatus of claim 16, wherein at least one of the threaded rods includes a hole, for communicating the interior of the rod with at least one of the bladder chambers, and at least one other of the threaded rods has no hole, and does not communicate with either of the bladder chambers.

18. An in-borehole installation, comprising a work-pipe and a string of the packer apparatuses of claim 5, disposed at different depths along the work-pipe, wherein:

the string includes an uppermost packer apparatus, and a lowermost packer apparatus;

a surface length of inflation tubing runs from the upper fluid port of the uppermost packer up to the ground surface, for connection to the pressure source means;

the lower fluid port of the lowermost packer is plugged;

in respect of each pair of adjacent packers on the work-pipe, a respective connecting length of inflation tubing runs between the lower fluid port of the upper one of the packers of the pair to the upper fluid port of the lower one of the packers of the pair.

19. A procedure for installing borehole packer apparatuses, including the steps of:

providing a work-pipe and a plurality of the packer apparatuses of claim 6;

applying vacuum to the fluid port of each packer apparatus, and assembling that packer apparatus onto the work-pipe to form an assembly comprising the work-pipe and the string of packers on the work-pipe;

releasing the vacuum from all the packers;

fitting a surface length of inflation tubing to the upper fluid port of an uppermost one of the packers;

fitting connecting lengths of inflation tubing between adjacent packers;

lowering the assembly down into the borehole, to a working depth;

then applying pressurised fluid to the fluid port, the fluid being at such pressure as to inflate the outer bladders into contact with the inwards-facing wall of the borehole;

maintaining pressure from the ground surface, in such manner that the pressure can be released, from the ground surface.

* * * * *